US009116467B2

(12) United States Patent
Hayashi et al.

(10) Patent No.: US 9,116,467 B2
(45) Date of Patent: Aug. 25, 2015

(54) DEVELOPING APPARATUS HAVING A CUTTING SURFACE AT AN END PORTION AND PROCESS CARTRIDGE

(71) Applicant: CANON KABUSHIKI KAISHA, Tokyo (JP)

(72) Inventors: Kodai Hayashi, Suntou-gun (JP); Hisashi Taniguchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/863,114

(22) Filed: Apr. 15, 2013

(65) Prior Publication Data

US 2013/0279947 A1 Oct. 24, 2013

(30) Foreign Application Priority Data

Apr. 18, 2012 (JP) ..... 2012-094970

(51) Int. Cl.
*G03G 15/08* (2006.01)
*G03G 21/18* (2006.01)

(52) U.S. Cl.
CPC ..... *G03G 15/0877* (2013.01); *G03G 21/18* (2013.01); *G03G 21/1814* (2013.01); *G03G 15/0812* (2013.01)

(58) Field of Classification Search
CPC ..... G03G 15/0812; G03G 15/0877; G03G 21/18; G03G 21/1814
USPC ..... 399/284
See application file for complete search history.

(56) References Cited

U.S. PATENT DOCUMENTS

| | | | | |
|---|---|---|---|---|
| 5,867,758 | A * | 2/1999 | Yoshida et al. | 399/284 |
| 5,875,379 | A * | 2/1999 | Machida et al. | 399/284 |
| 6,064,463 | A * | 5/2000 | Yamada et al. | 355/27 |
| 6,604,399 | B1 * | 8/2003 | Yoshida et al. | 72/326 |
| 2003/0194250 | A1 * | 10/2003 | Ishigaki | 399/279 |
| 2005/0111885 | A1 * | 5/2005 | Ishigaki | 399/279 |
| 2005/0260014 | A1 * | 11/2005 | Nakano et al. | 399/284 |
| 2007/0147905 | A1 * | 6/2007 | Nakano et al. | 399/284 |
| 2008/0247791 | A1 * | 10/2008 | Iwata et al. | 399/350 |
| 2009/0123205 | A1 * | 5/2009 | Watanabe et al. | 399/350 |
| 2011/0158698 | A1 * | 6/2011 | Sato | 399/254 |
| 2011/0158707 | A1 * | 6/2011 | Agata | 399/284 |
| 2012/0301189 | A1 * | 11/2012 | Kase et al. | 399/284 |

FOREIGN PATENT DOCUMENTS

| | | |
|---|---|---|
| JP | H03-215886 A | 9/1991 |
| JP | 2002-372858 A | 12/2002 |

(Continued)

OTHER PUBLICATIONS

Machine translation of JP 2006263852 A.*

*Primary Examiner* — David Bolduc
(74) *Attorney, Agent, or Firm* — Canon USA, Inc., IP Division

(57) ABSTRACT

A developing apparatus used in an image forming apparatus, including: a developer carrying member configured to carry a developer; and a control member configured to control the amount of a developer carried on the developer carrying member, wherein the control member is manufactured by cutting a supporting member covered with a covering member in a cutting direction intersecting a surface of the supporting member so as to be a predetermined length in the longitudinal direction thereof, and the covering member provided on the upstream side of the control member in the cutting direction comes into contact with the developer carrying member.

8 Claims, 5 Drawing Sheets

(56) References Cited

FOREIGN PATENT DOCUMENTS

| | | | |
|---|---|---|---|
| JP | 2006263852 | A * | 10/2006 |
| JP | 2008-90160 | A | 4/2008 |
| JP | 2008-256907 | A | 10/2008 |

* cited by examiner

DEVELOPING APPARATUS HAVING A CUTTING SURFACE AT AN END PORTION AND PROCESS CARTRIDGE

BACKGROUND OF THE INVENTION

1. Field of the Invention

The present disclosure relates to a developing apparatus and a process cartridge.

2. Description of the Related Art

Image forming apparatuses such as electrophotographic copying machines, laser beam printers, and facsimiles are provided with a developing apparatus configured to develop an electrostatic latent image formed on a surface of a photosensitive member. The developing apparatus includes a toner container configured to store toner as a developer, a developing roller as a developer carrying member configured to carry and convey the toner, and a control blade configured to control the amount of toner on the developing roller constant (an amount-of-developer control blade) by being arranged in contact with the developing roller.

An excessive part of toner adhered to a surface of the developing roller from the toner container is removed when passing through a contact position with respect to the control blade in association with the rotation of the developing roller and is returned back to the toner container. At this time, the toner remaining on the developing roller moves to the surface of the photosensitive member by being provided with a friction charge (also referred to as "triboelectricity") by a friction with respect to the control blade.

In the related art, as such a control blade, a configuration in which a blade member formed of a rubber-like resilient member is adhered to a metallic supporting member with an adhesive agent is known. In this configuration, the control blade is allowed to be brought into a press contact easily with the developing roller over the entire length with an even press-contact force, and high durability is achieved.

The surface of the blade member brought into press-contact with the developing roller has a function to control the friction charge of the toner, and hence is referred to also as a "charge control surface". Examples of a material of the charge control surface include urethane rubber, a polyamide resin, a polyamide elastomer, silicone rubber, and a silicone resin.

In the developing apparatus compatible to high image quality and full-color image formation associated with speed enhancement, since toner having fine particles is used, a control blade which allows press-contact with the developing roller with higher uniformity is required.

Therefore, for example, Japanese Patent Laid-Open No. 2002-372858 discloses a control blade configured in such a manner that blade members having substantially the same shape, an adhesive agent, and a supporting member are laminated over the entire surfaces one on top of another to form layers. Japanese Patent Laid-Open No. 2008-90160 discloses a control blade configured in such a manner that a blade member covers an area of a supporting member over an area at least from a contact surface with respect to a developing roller to a distal end surface. By employing the control blade of this configuration, a uniform press-contact with the developing roller is enabled, and high image quality and full-color image formation may be accommodated.

In the control blades (control members) disclosed in Japanese Patent Laid-Open No. 2002-372858 and Japanese Patent Laid-Open No. 2008-90160, the blade members (covering members) adhered to and covered with the supporting member are kept in sliding contact with the developing roller while keeping a constant pressure. Therefore, the blade member is worn and shaved in association with the usage of the developing apparatus.

In particular, a pressure with respect to the developing roller is high at a portion of the blade member near longitudinal end portions or a portion sandwiched between an end seal for preventing toner leakage and the developing roller, and hence is susceptible to abrasion in comparison with an image forming area in the vicinity of a center of the control blade. In addition, the longitudinal end portions of the control blade may be positioned having an inflected shape, or may expose the adhered surface with respect to the supporting member. Consequently, when being shaved, separation may occur at a single stroke so as to be curled up from the longitudinal end portions and hence the supporting member may be exposed.

When such exposure of the supporting member caused by the wear or the separation as described above reaches the image forming area, the uniformity of the contact pressure cannot be maintained in the exposed portions and hence image defects such as formation of stripes or density unevenness may occur.

SUMMARY OF THE INVENTION

The disclosure provides a developing apparatus in which separation of a covering member is reduced to achieve stable image formation and a process cartridge provided with the developing apparatus.

A representative configuration of the disclosure is a developing apparatus used in an image forming apparatus, including: a developer carrying member configured to carry a developer; and a control member configured to control the amount of a developer carried on the developer carrying member, wherein the control member is manufactured by cutting a supporting member covered with a covering member in a cutting direction intersecting a surface of the supporting member so as to be a predetermined length in the longitudinal direction thereof, and the covering member provided on the upstream side of the control member in the cutting direction comes into contact with the developer carrying member.

Another configuration disclosed herein is a process cartridge demountably mountable with respect to an apparatus body of an image forming apparatus including: an image carrying member on which a latent image is formed; a developer carrying member configured to carry a developer for developing the latent image; and a control member configured to control the amount of a developer carried on the developer carrying member, wherein the control member is manufactured by cutting a supporting member covered with a covering member in a cutting direction intersecting the surface of the supporting member so as to be a predetermined length in the longitudinal direction thereof, and the covering member provided on the upstream side of the control member in the cutting direction comes into contact with the developer carrying member.

Further features of the present invention will become apparent from the following description of exemplary embodiments with reference to the attached drawings.

DESCRIPTION OF THE EMBODIMENTS

Figure 1:
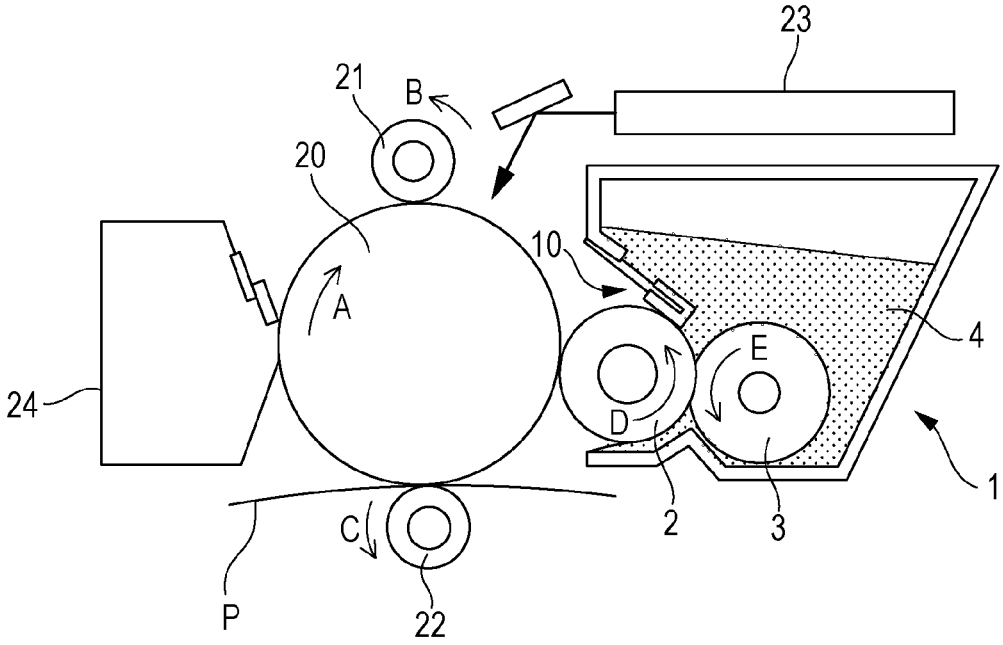
FIG. 1 is a schematic cross-sectional view illustrating a configuration of an image forming apparatus according to an example.

Referring now to the drawings, an embodiment for carrying out the invention will be illustratively described. Sizes, materials, shapes, and relative arrangement of the components described in the example are not intended to limit the scope of the invention only to those values unless otherwise specifically described.

Image Forming Apparatus

Referring now to FIG. 1, a configuration of an image forming apparatus provided with a developing apparatus according to the example will be described. In the example, a laser beam printer is used for the description as an example of the image forming apparatus. However, the developing apparatus according to the invention may be applied to electrophotographic copying machines, facsimile machines, and the like. FIG. 1 is a schematic cross-sectional view illustrating the configuration of the image forming apparatus according to the example. The image forming apparatus according to the example disclosed herein includes a photosensitive drum 20 as an image carrying member rotated by a drive source (not illustrated) in the direction indicated by an arrow A in FIG. 1. In the example, the photosensitive drum 20 is an organic photosensitive member coated with an undercoat layer, a carrier generating layer, and a carrier conveying layer as a functional layer in sequence on an outer peripheral surface of an aluminum cylinder. As illustrated in FIG. 1, a developing apparatus 1, a charging roller 21, a transfer roller 22, an exposure apparatus 23, and a cleaning apparatus 24 are arranged in the periphery of the photosensitive drum 20. In the example, the photosensitive drum 20 and the developing apparatus 1 as a process unit configured to act on the photosensitive drum 20, the charging roller 21, and the cleaning apparatus 24 are integrated to form a process cartridge. The process cartridge is configured to be demountably mountable with respect to an image forming apparatus body.

The charging roller 21 as a charging unit is driven to rotate in the direction indicated by an arrow B in FIG. 1 by bringing the conductive rubber on the surface thereof into press-contact with the photosensitive drum 20. A core metal of the charging roller 21 is applied with a predetermined DC voltage, whereby a uniform dark-area potential is formed on a surface of the photosensitive drum 20. The exposure apparatus 23 as an exposing unit is configured to irradiate the surface of the photosensitive drum 20 with a laser beam emitted on the basis of image information. A portion on the photosensitive drum 20 irradiated with the laser beam looses an electric charge from the surface thereof by a carrier from the carrier generating layer, so that the surface potential thereof is lowered. Consequently, an electrostatic latent image having a predetermined light area potential in an exposed portion (image portion) which is irradiated with the laser beam and a predetermined dark area potential in a non-exposed portion (non-image portion) which is not irradiated with the laser beam is formed on the surface of the photosensitive drum 20. The developing apparatus 1 forms a toner image as a developer image by developing the electrostatic latent image formed on the surface of the photosensitive drum 20. The transfer roller 22 provided so as to be rotatable in the direction indicated by an arrow C in FIG. 1 is applied with a bias voltage having an opposite polarity from a regular charged polarity of the developer from a primary transfer bias power source (high-voltage power source), not illustrated, and the toner image formed on the photosensitive drum 20 is transferred to a transfer material P such as a piece of paper (see FIG. 2). The toner remaining on the photosensitive drum 20 without being transferred to the transfer material P is collected by the cleaning apparatus 24.

Developing Apparatus

Figure 2:
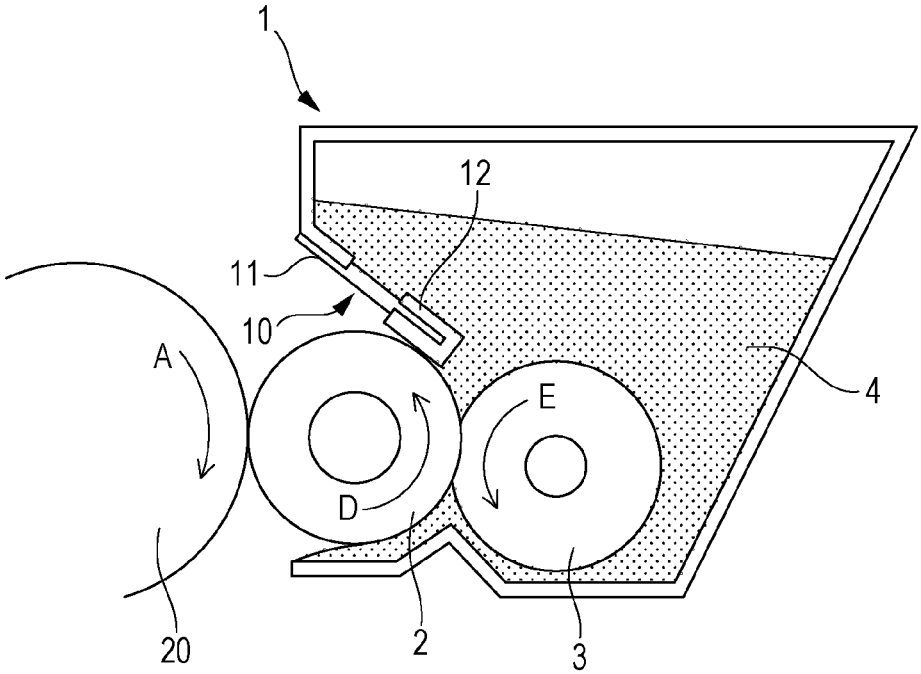
FIG. 2 is a schematic cross-sectional view illustrating a configuration of a developing apparatus according to the example.

Subsequently, a configuration of the developing apparatus according to the example will be described with reference to FIG. 1 and FIG. 2. FIG. 2 is a schematic cross-sectional view illustrating the configuration of the developing apparatus according to the example. In the example, a one-component contact developing system is employed as a developing system using non-magnetic one-component toner as the toner. The developing apparatus 1 includes a developing roller 2 as a developer carrying member, a toner supply roller 3, and an amount-of-developer control blade (control member, hereinafter, referred to simply as a control blade) 10. The developing roller 2 is provided so as to be rotatable in the direction indicated by an arrow D in the drawing in contact with the photosensitive drum 20. As illustrated in FIG. 1, the developing roller 2 and the photosensitive drum 20 rotate respectively so that the surfaces thereof move in the same direction at a contact portion (opposed portion). The toner supply roller 3 is provided so as to be rotatable in the direction indicated by an arrow E in the drawing, and supplies toner 4 stored in the interior of the developing apparatus 1 to the developing roller 2. The control blade 10 comes into contact with the developing roller 2 to control the amount of toner (the amount of developer) on the developing roller 2 (on the developer carrying member) and provide an electric charge thereto.

The control blade 10 includes a blade member (covering member) 12 and a supporting member 11 configured to support the blade member 12. The control blade 10 is arranged so as to be capable of causing the surface of the blade member 12 to come into contact with the developing roller 2 over the entire length thereof in the longitudinal direction at a predetermined pressure by using spring resiliency of the supporting member 11. The toner on the developing roller 2 is conveyed to the contact portion between the control blade 10 and the developing roller 2 by the rotation of the developing roller 2, and is provided with an electric charge by being triboelectrically charged thereby and, simultaneously, the layer thickness thereof is controlled. The toner on the developing roller 2 whose layer thickness is controlled is conveyed to the contact portion with respect to the photosensitive drum 20 by the rotation of the developing roller 2, and visualizes the electrostatic latent image formed on the photosensitive drum 20. Consequently, a toner image as a developer image is formed on the photosensitive drum 20.

Control Blade

Figure 3:
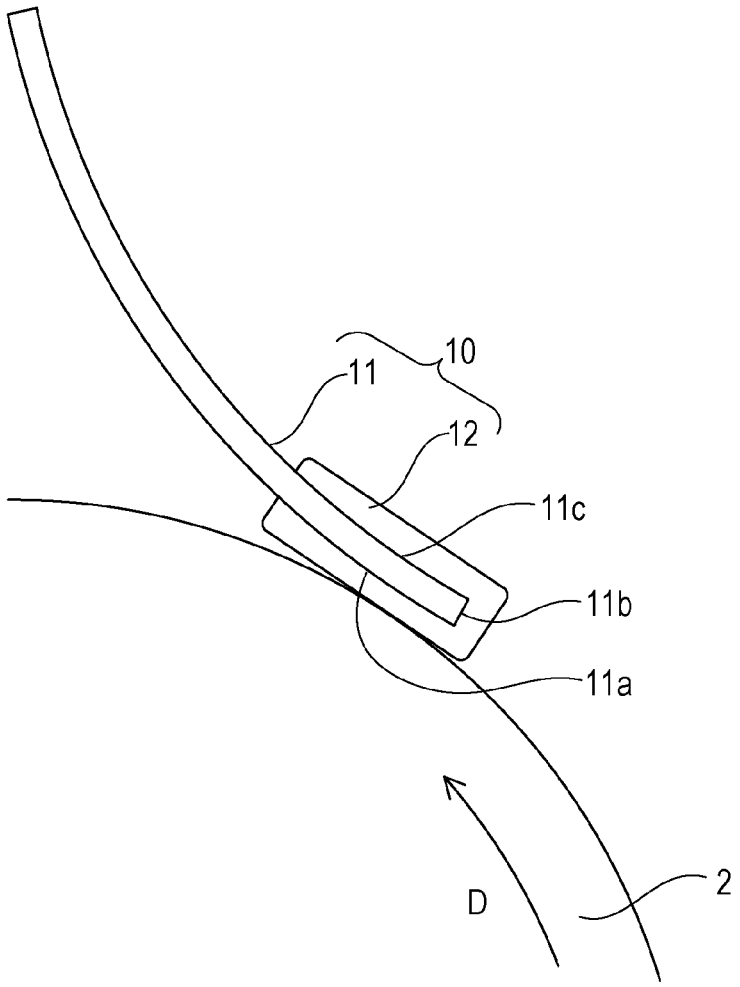
FIG. 3 is an enlarged cross-sectional view illustrating a control blade according to the example.

The control blade of the example will be described further with reference to FIG. 3. FIG. 3 is an enlarged cross-sectional view illustrating the control blade according to the example.

As illustrated in FIG. 3, surfaces of the supporting member 11 are defined as follows. A surface on the side coming into contact with the developing roller 2 is defined as a contact supporting surface 11*a*, a surface at a distal end is defined as a distal end surface 11*b*, and a surface on the back side (opposite side) of the contact supporting surface is defined as a back surface 11*c*. The material of the supporting member 11 is not specifically limited as long as the blade member 12 can be formed on the surfaces thereof. The shape of the supporting member 11 is preferably a flat shape or a curved plate shape formed by curving the flat shape. The blade member 12 is formed of a coat containing a resin or an elastomer as a main material. The blade member 12 formed of the coat preferably covers an area from the contact supporting surface 11*a* to the distal end surface 11*b* and the back surface 11*c* of the supporting member 11 integrally. In this configuration, the blade member 12 may be restrained from being separated from the supporting member 11 by a friction caused by a sliding movement with respect to the developing roller 2.

Method of Manufacturing Control Blade

Figure 4:
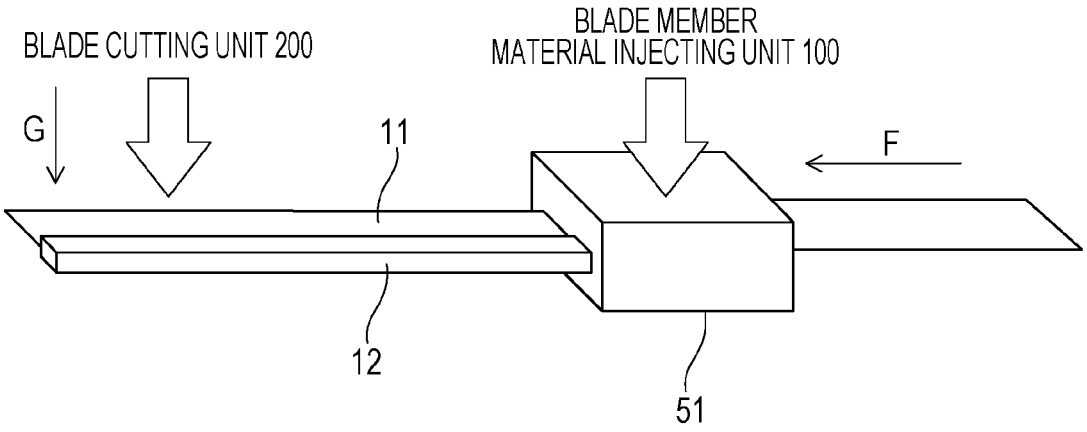
FIG. 4 is a schematic perspective view illustrating a method of manufacturing the control blade according to the example.
Figure 5:
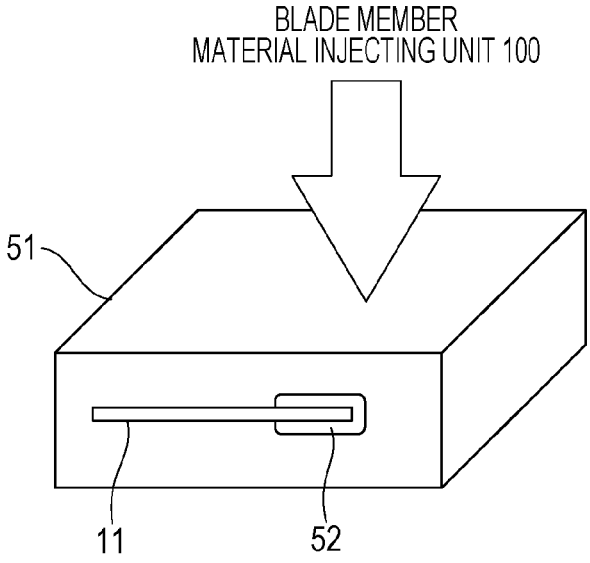
FIG. 5 is a schematic cross-sectional view illustrating a control blade manufacturing apparatus according to the example.
Figure 6:
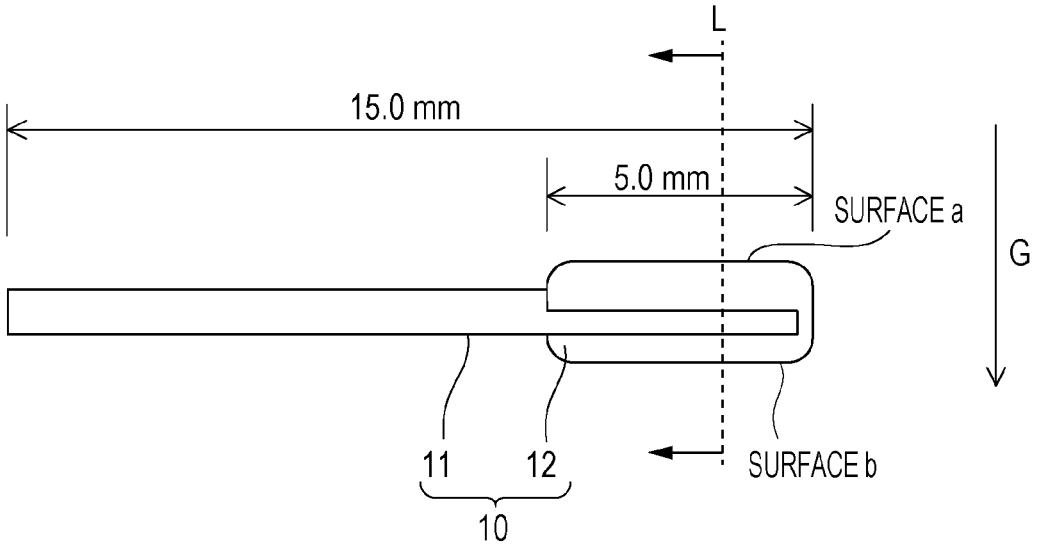
FIG. 6 is a general view of the control blade according to the example.

Subsequently, a method of manufacturing the control blade according to the example will be described with reference to FIG. 4 to FIG. 6. FIG. 4 is a schematic perspective view illustrating the method of manufacturing the control blade of the example. FIG. 5 is a schematic cross-sectional view illustrating a control blade manufacturing apparatus of the example. FIG. 6 is a general view illustrating the control blade according to the example. First of all, a phosphor-bronze thin plate (manufactured by HARADA METAL INDUSTRY Co., Ltd.) having a thickness of 0.1 mm, which is a plate member as a material of the supporting member 11 is conveyed in the direction indicated by an arrow F in FIG. 4, and is inserted into an extrusion molding machine (PLA GIKEN Co., Ltd) using a special die 51. The special die 51 is a die having a molding area 52, which is a rectangular molding port having a discharging port of 5 mm×0.3 mm as illustrated in FIG. 5.

The material of the blade member 12 is injected in sequence into the molding area 52 of the special die 51 by a blade member material injecting unit 100 while causing the plate member to be travelled in the extrusion molding machine. In the example, a polyamide elastomer (manufactured by Daicel Degussa Co., Ltd., product name: DAIAMID E40) at a Shore D hardness of 40° specified by JIS D6253 is used as the material of the blade member 12, is melted at temperatures of 200 to 270° C., and is injected into the molding area 52.

Then, by solidifying polyamide elastomer, the blade member 12 is integrally molded into a plate member. In addition, the plate member on which the blade member 12 is integrally molded is extruded from the discharging port, so that a control blade sheet is obtained. In addition, the control blade sheet is cut into a length which allows the blade member 12 to come into contact with the developing roller 2 over the entire length of the blade member 12 in the longitudinal direction by a blade cutting unit 200. In other words, the control blade sheet (the supporting member 11 in a state of being covered with the blade member 12) is cut so that the control blade 10 becomes a predetermined length in the longitudinal direction. In the example, the control blade sheet is cut into a length of 230 mm and a width of 15 mm in the direction indicated by an arrow G in FIG. 4 (the direction intersecting the surface of the supporting member 11), whereby the control blade 10 illustrated in FIG. 6 is obtained.

Figure 7:
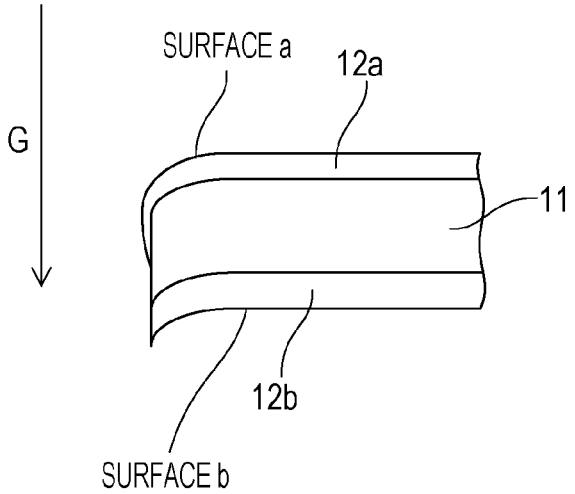
FIG. 7 is an enlarged cross-sectional view of a longitudinal end portion of the control blade according to the example.
Figure 8:
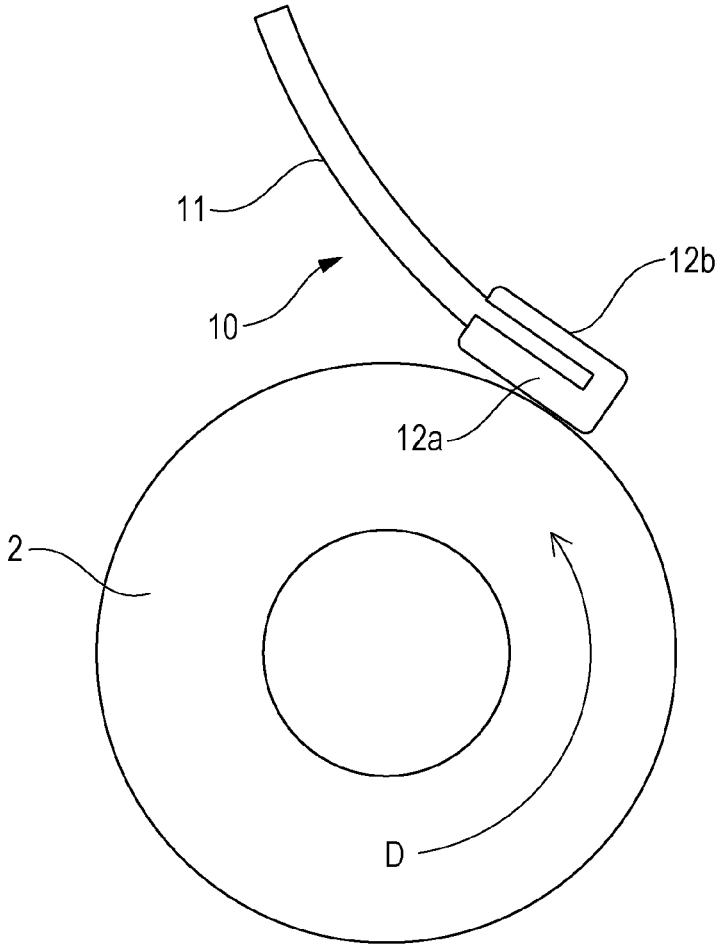
FIG. 8 is a drawing illustrating a state of contact of the control blade according to the example.

Subsequently, with reference to FIG. 7 and FIG. 8, a method that the control blade 10 comes into contact with the developing roller 2 will be described. FIG. 7 is a cross-sectional view illustrating a longitudinal end portion of the control blade from a cross-sectional view taken along the dot line L in FIG. 6. FIG. 8 is a drawing illustrating a state in which the control blade comes into contact with the developing roller. Here, as illustrated in FIG. 7, a surface of the control blade 10 on the side where cutting by the blade cutting unit 200 is started (the upstream side in the cutting direction) is defined as a surface a and a surface on the side where the cutting is terminated is defined as a surface b. The surface a side of the blade member (covering member) 12 covering the supporting member 11 in the cross sectional view in FIG. 7 is defined as a blade member 12*a*, and the surface b side is defined as a blade member 12*b*. As illustrated in FIG. 7, a droop in the direction indicated by the arrow G in FIG. 7 is generated at the longitudinal end portion of the control blade 10, and the blade member 12*a* and the blade member 12*b* have different shapes at the longitudinal end portions thereof. In other words, as illustrated in FIG. 7, a longitudinal end portion surface of the supporting member 11 (an end portion of the supporting member 11 formed by being cut) is covered with the blade member 12*a* on the surface a side, but is partly exposed on the surface b side without being covered with the blade member 12*b*.

When the surface b is brought into contact with the developing roller 2, an end portion of the blade member 12*b* is curved in the direction intruding into the developing roller 2, so that the contact pressure of the control blade 10 with respect to the developing roller 2 is increased at the longitudinal end portions thereof. Due to manufacturing reasons of the control blade 10, the surface b side of the longitudinal end portion surface of the supporting member 11 is not covered with the blade member 12*b*, and the contact surface between the blade member 12*b* and the supporting member 11 is exposed. Therefore, the blade member 12*b* tends to be separated from the supporting member 11 from the longitudinal end portions of the blade member 12*b*.

In contrast, when the surface a is brought into contact with the developing roller 2, an end portion of the blade member 12*a* is curved in the direction away from the developing roller 2, so that the contact pressure of the control blade 10 with respect to the developing roller 2 may be decreased at the longitudinal end portions thereof in comparison with a case where the surface b is brought into contact therewith. As illustrated in FIG. 7, the surface a side of the longitudinal end portion surface of the supporting member 11 is covered with the blade member 12*a*, and hence the contact surface between the blade member 12*a* and the supporting member 11 is not exposed. Therefore, even when the sliding movement with respect to the developing roller 2 is repeated, the blade member 12 can hardly be separated from the supporting member 11.

The control blade 10 according to the example is characterized by a configuration in which the blade member 12*a* on the surface a side comes into contact with the developing roller 2. In order to enhance the effect of the restraint of the separation, the thickness of the coat as the blade member 12 is preferably at least 10 μm. The reason is that if the thickness of the coat is at least 10 μm, the longitudinal end portion surface of the supporting member 11 may be covered with the blade member 12*a* by the droop generated at the time of cutting. In the example, at the time of manufacture of the control blade 10, the thickness of the blade member 12 on the supporting member 11 is set to be 10 μm by adjusting the amount of extrusion of the resin and the feeding speed of the plate member.

Result of Experiment

An experiment was conducted in order to prove the effect of the invention. Specifically, the developing apparatus described above was mounted on the image forming apparatus, and a two-sheet intermittent print endurance test that performs printing on two sheets at intervals under an environment of normal temperature and normal humidity conditions (temperature: 23° C., humidity: 50%) was conducted. In this test, recording images composed of horizontal lines at an image ratio of 1% are printed. Then, an evaluation of defect image and an evaluation of separation of the control blade 10 were conducted when the number of printed sheets reached 5000 sheets, 10000 sheets, 15000 sheets, 20000 sheets, and 25000 sheets. Images used for the image defect evaluation were a solid black image and a half tone image. The evaluation of separation was conducted by disassembling the developing apparatus 1 to a state in which the contact surface between the control blade 10 and the developing roller 2 was visible, and visually observing the control blade 10.

The result of test was ranked as shown below, and the separation of the blade member 12 from the supporting member 11 was evaluated.

A: No exposure of the supporting member 11 caused by abrasion or separation of the blade member 12 was observed.

B: Exposure of the supporting member 11 caused by abrasion or separation of the blade member 12 was observed at an end portion of the control blade 10.

C: Exposure of the supporting member 11 was observed at a portion of the control blade 10 corresponding to the image forming area, and image defects such as generation of strips or unevenness occurred.

As another comparative example of the effect, a similar experiment was conducted by bringing the blade member 12*b* on the surface b side on the downstream side in the cutting direction into contact with the developing roller 2. The result of experiment is shown in Table 1.

TABLE 1

| | NUMBER OF PRINT ENDURABLE SHEETS (SHEETS) | | | | |
|---|---|---|---|---|---|
| | 5000 | 10000 | 15000 | 20000 | 25000 |
| EXAMPLE | A | A | A | A | A |
| COMPARATIVE EXAMPLE | A | A | B | C | C |

As shown in Table 1, in the configuration of a comparative example, exposure of the supporting member 11 was observed at the longitudinal end portion portions of the control blade 10 at the time point when 15000 sheets were printed. Furthermore, at the time when the 20000 sheets were printed, exposure of the developing apparatus 1 was observed not only at the end portions but also in an area near the center which corresponds to the area of image formation, and the defect image was generated. In contrast, with the configuration of the example, exposure of the supporting member 11 was not observed even at the time point when 25000 sheets were printed, and the stable image formation was achieved.

As described above, with the control blade 10 of the example, the blade member 12 may be restrained from being separated from the supporting member 11 at the longitudinal end portions thereof. Consequently, the image forming apparatus provided with the developing apparatus capable of stable image formation may be provided.

In the example, the developing apparatus 1 constitutes the process cartridge with the photosensitive drum 20, and the process cartridge is configured to be demountably mountable with respect to the image forming apparatus body. However, a configuration in which the developing apparatus 1 constitutes solely the cartridge (developing cartridge) and the developing cartridge is demountably mountable with respect to the image forming apparatus body is also applicable. The developing apparatus 1 may be provided in the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-094970 filed Apr. 18, 2012, which is hereby incorporated by reference herein in its entirety.

What is claimed is:

1. A developing apparatus used in an image forming apparatus, comprising:

a developer carrying member configured to carry a developer; and a control member configured to control an amount of a developer carried on the developer carrying member, wherein the control member is manufactured by cutting a supporting member covered with a covering member in a cutting direction intersecting a surface of the supporting member to be a predetermined length in the longitudinal direction thereof, the control member has a free end, the covering member is provided near the free end of the control member and covers a part of an opposed surface facing the developer carrying member, a part of a non-opposed surface located opposite to the opposed surface and an end surface located at the free end, the opposed surface of the supporting member is a surface located at an upstream side, in the cutting direction, of the supporting member and the covering member provided on the opposed surface comes into contact with the developer carrying member, in a cutting surface formed by cutting the supporting member, an upstream side in the cutting direction of the cutting surface is covered with the covering member extending from the opposed surface to downstream in the cutting direction, a downstream side in the cutting direction of the cutting surface is exposed from the covering member, and the covering member provided on the non-opposed surface protrudes toward downstream in the cutting direction at a longitudinal end of the control member.

2. The developing apparatus according to claim 1, wherein a thickness of the covering member coming into contact with the developer carrying member is at least 10 μm.

3. The developing apparatus according to claim 1, wherein the supporting member is a plate member.

4. The developing apparatus according to claim 1, wherein the covering member is formed of a resin or an elastomer.

5. A process cartridge demountably mountable with respect to an apparatus body of an image forming apparatus comprising:

an image carrying member on which a latent image is formed;

a developer carrying member configured to carry a developer for developing the latent image; and a control member configured to control the amount of a developer carried on the developer carrying member, wherein the control member is manufactured by cutting a supporting member covered with a covering member in a cutting direction intersecting a surface of the supporting member to be a predetermined length in the longitudinal direction thereof, the control member has a free end, the covering member is provided near the free end of the control member and covers a part of an opposed surface facing the developer carrying member, a part of a non-opposed surface located opposite to the opposed surface and an end surface located at the free end, the opposed surface of the supporting member is a surface located at an upstream side, in the cutting direction, of the supporting member and the covering member provided on the opposed surface comes into contact with the developer carrying member, in a cutting surface formed by cutting the supporting member, an upstream side in the cutting direction of the cutting surface is covered with the covering member extending from the opposed surface to downstream in the cutting direction, a downstream side in the cutting direction of the cutting surface is exposed from the covering member, and the covering member provided on the non-opposed surface protrudes toward downstream in the cutting direction at a longitudinal end of the control member.

6. The process cartridge according to claim 5, wherein a thickness of the covering member coming into contact with the developer carrying member is at least 10 μm.

7. The process cartridge according to claim 5, wherein the supporting member is a plate member.

8. The process cartridge according to claim 5, wherein the covering member is formed of a resin or an elastomer.

* * * * *